US008468660B2

(12) United States Patent
Holler

(10) Patent No.: US 8,468,660 B2
(45) Date of Patent: Jun. 25, 2013

(54) EJECTOR MECHANISM FOR ROTARY BUCKLE ASSEMBLY

(75) Inventor: Kevin Holler, Belleair, FL (US)

(73) Assignee: Conax Florida Corporation, St. Petersburg, FL (US)

( * ) Notice: Subject to any disclaimer, the term of this patent is extended or adjusted under 35 U.S.C. 154(b) by 301 days.

(21) Appl. No.: 12/837,088

(22) Filed: Jul. 15, 2010

(65) Prior Publication Data

US 2011/0010901 A1 Jan. 20, 2011

Related U.S. Application Data

(60) Provisional application No. 61/225,783, filed on Jul. 15, 2009.

(51) Int. Cl.
*A44B 11/25* (2006.01)

(52) U.S. Cl.
USPC ..... 24/632; 24/634; 24/579.11; 24/573.11; 297/484; 297/467

(58) Field of Classification Search
USPC ..... 24/629, 630, 631, 632, 642, 634, 24/593.1, 579.11, 579.09, 573.11, 643, DIG. 52, 24/DIG. 35, DIG. 47; 297/484, 467
See application file for complete search history.

(56) References Cited

U.S. PATENT DOCUMENTS

| | | | | |
|---|---|---|---|---|
| 2,892,232 | A | 8/1959 | Miller et al. | |
| 2,899,732 | A | 8/1959 | Cushman | |
| 3,564,672 | A | 2/1971 | McIntyre | |
| 3,639,948 | A * | 2/1972 | Sherman | 24/632 |
| 3,747,167 | A * | 7/1973 | Pravaz | 24/573.11 |
| 4,610,058 | A * | 9/1986 | Stemmildt et al. | 24/579.11 |
| 4,656,700 | A | 4/1987 | Tanaka et al. | |
| 4,742,604 | A * | 5/1988 | Mazelsky | 24/579.09 |
| 7,065,843 | B1 * | 6/2006 | Wu | 24/642 |
| 7,716,794 | B2 * | 5/2010 | Wu | 24/579.11 |

FOREIGN PATENT DOCUMENTS

| | | |
|---|---|---|
| FR | 1298012 | 7/1961 |
| GB | 1582973 | 1/1961 |

* cited by examiner

*Primary Examiner* — Robert J Sandy
*Assistant Examiner* — Rowland D Do
(74) *Attorney, Agent, or Firm* — GrayRobinson, P.A.; Michael J. Colitz, III

(57) ABSTRACT

A rotary buckle assembly for a harness. The assembly is adapted to selectively secure or eject the tongue plates for the straps of the harness. Although the invention finds particular application for use with a five point harness, it can be adapted for use with other harness arrangements.

10 Claims, 6 Drawing Sheets

FIG. 1
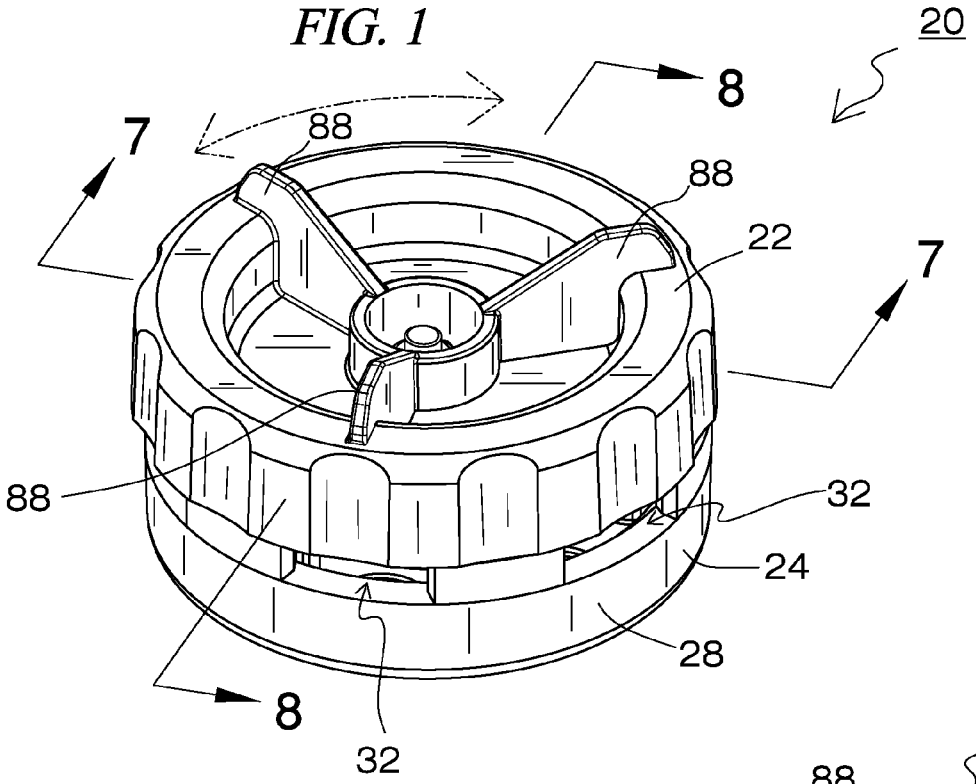
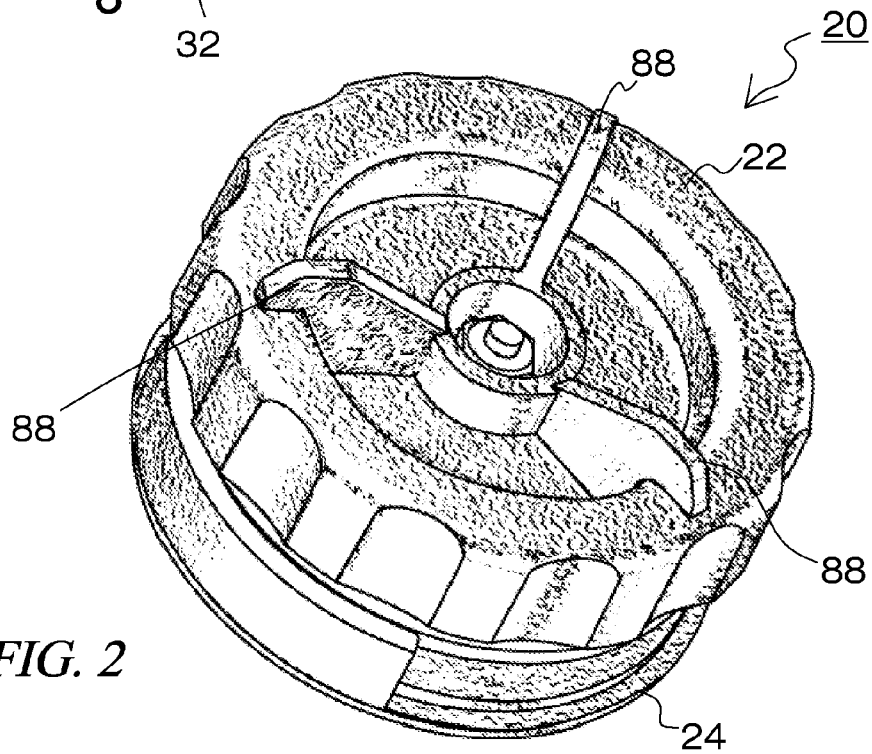
FIG. 2

FIG. 3
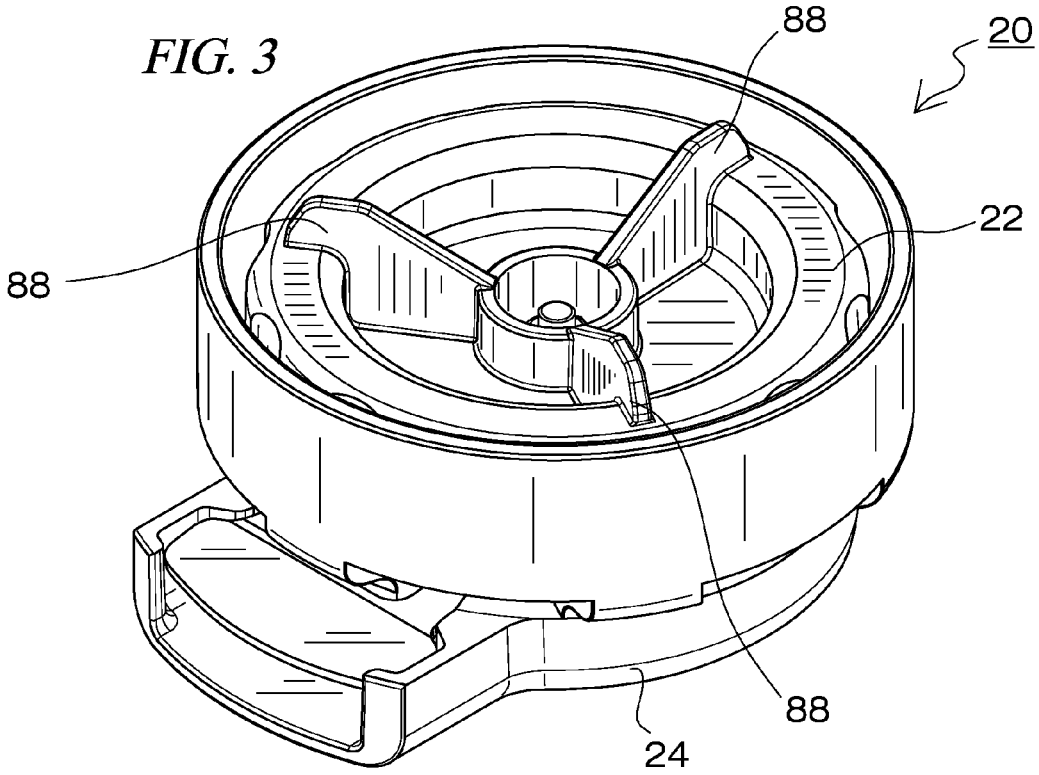
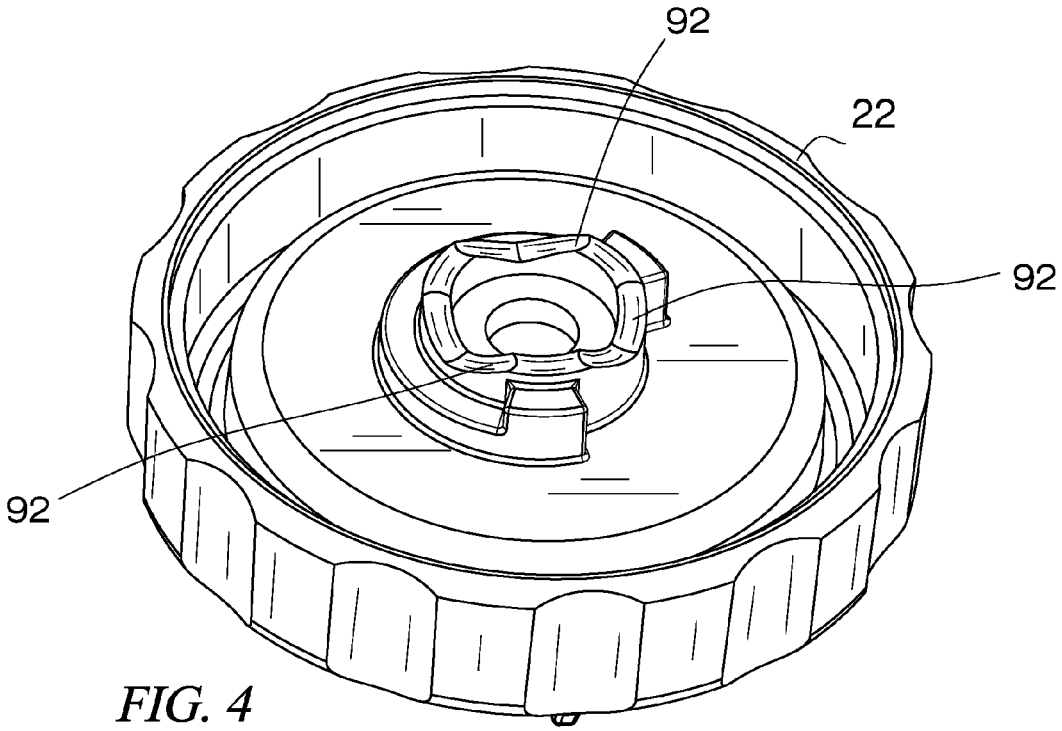
FIG. 4

EJECTOR MECHANISM FOR ROTARY BUCKLE ASSEMBLY

RELATED APPLICATION DATA

This application claims the benefit of U.S. Provisional Application Ser. No. 61/225,783 filed on Jul. 15, 2009 and entitled "Ejector Mechanism for Rotary Buckle Assembly," the contents of of which are fully incorporated herein.

BACKGROUND OF THE INVENTION

1. Field of the Invention

This invention relates to a rotary buckle assembly. More specifically, the present invention relates to a buckle assembly with improved tongue ejection mechanisms.

2. Description of the Background Art

The use of multipoint harnesses is known in the art. These harnesses generally include a series of four or more straps that are secured to a common buckle assembly by way of tongue plates. These harnesses further include a single release mechanism, whereby a user can simultaneously unlock all the tongue plates in a single operation.

An example of one such harness is described in U.S. Pat. No. 2,892,232 to Quilter. Quilter discloses a quick release device that employs a series of loading springs. The loading springs include forked leaves that engage rockers. The rockers, in turn, selectively engage strap lugs. The strap lugs can be disengaged by rotating a central knob.

Another example of a multipoint harness is disclosed in U.S. Pat. No. 2,899,732 to Cushman. Cushman discloses a quick release buckle that includes a tripping disc. Tripping disc engages a detent lub over the bias of a compression spring. The detent lubs include beveled surfaces for engaging an opening within the tongue strap.

Although each of the referenced inventions achieves it own individual objective, they all suffer from common drawbacks. Namely, none of the referenced inventions includes an ejection mechanism that forceably ejects the tongue from the housing when in the unlocked orientation. Nor does the cited art disclose an ejection mechanism that also serves to secure the tongue when in the locked orientation. Finally, none of the referenced inventions disclose an ejection mechanism that ensures the uniform and simultaneous ejection of all tongue plates.

SUMMARY OF THE INVENTION

It is therefore one of the objectives of this invention to provide an ejection mechanism for a multipoint harness wherein the mechanism forceably ejects a series of tongue plates when unlocked.

It is also an object of the present invention to provide an ejection mechanism that selectively secures and/or ejects a tongue plate.

It is a further object of the present invention to provide an ejection mechanism that ensures the uniform and simultaneous ejection of all tongue plates when unlocked.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective view of the rotary buckle of the present invention.

FIG. 2 is a perspective view of the textured surface of the rotary buckle.

FIG. 3 is a perspective view of the rotary buckle of the present invention.

FIG. 4 is a perspective view of the underside of the upper cover.

Similar reference characters refer to similar parts throughout the several views of the drawings.

DETAILED DESCRIPTION OF THE PREFERRED EMBODIMENT

Figure 5:
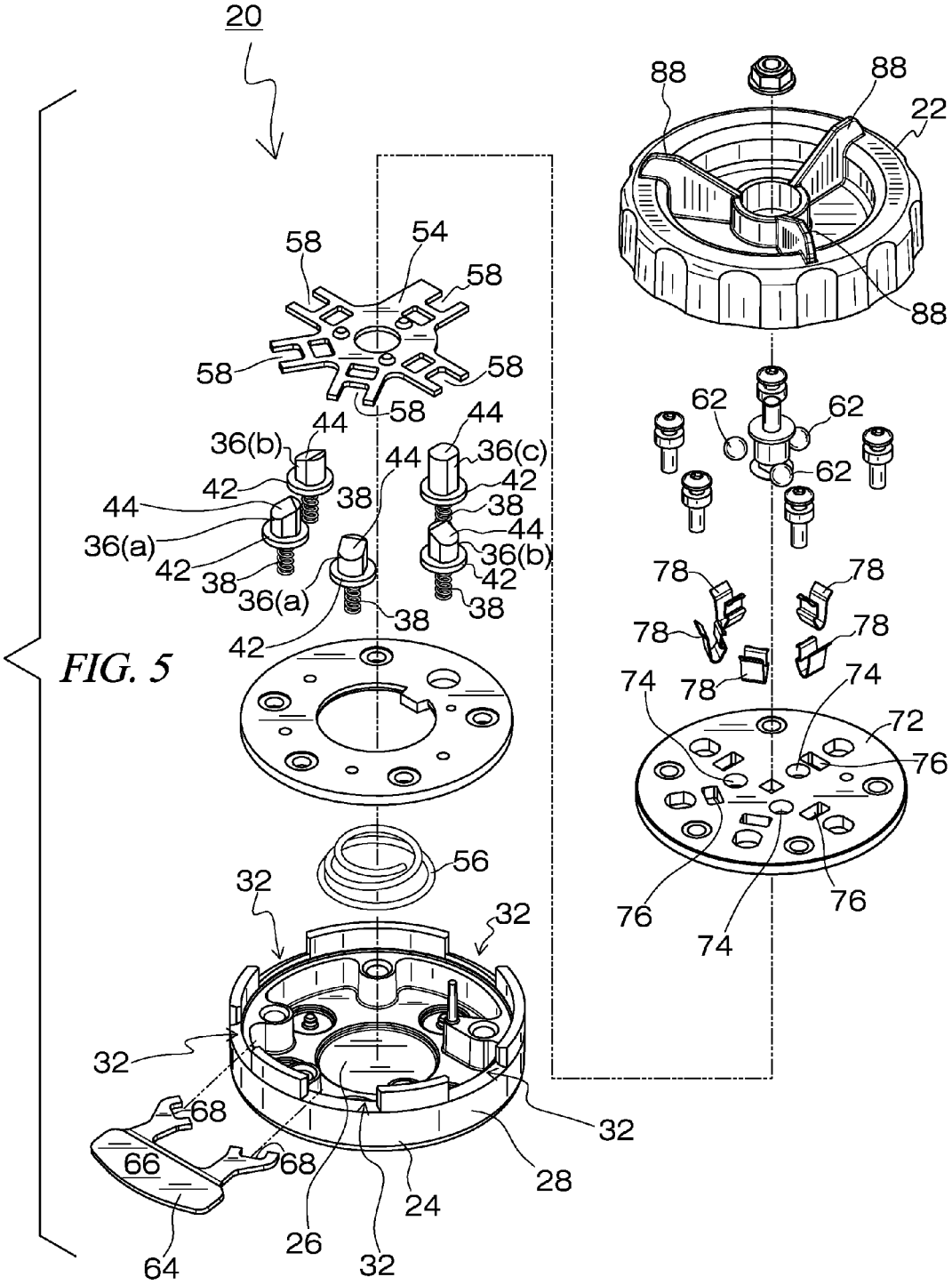
FIG. 5 is an exploded view of the rotary buckle of the present invention.

The present invention relates to a rotary buckle assembly for harness. The assembly is adapted to selectively secure or eject the tongue plates for the straps of the harness. Although the invention finds particular application for use with a five point harness, it can be adapted for use with other harness arrangements. The various features of the present invention, and the manner in which they interrelate, will be described in greater detail hereinafter.

With reference to FIG. 1, the buckle assembly 20 of the present invention is depicted. In the preferred embodiment, assembly 20 includes first and second cover portions (22 and 24). These covers (22 and 24) are preferably cylindrically shaped. Additionally, as noted in FIG. 5, second cover 24, which is the lowermost cover includes an inner surface 26 and an upstanding peripheral wall 28. In the preferred embodiment, peripheral wall 28 includes a series of five equally spaced tongue openings 32 to accept buckle tongues 94 as described hereinafter.

Figure 6:
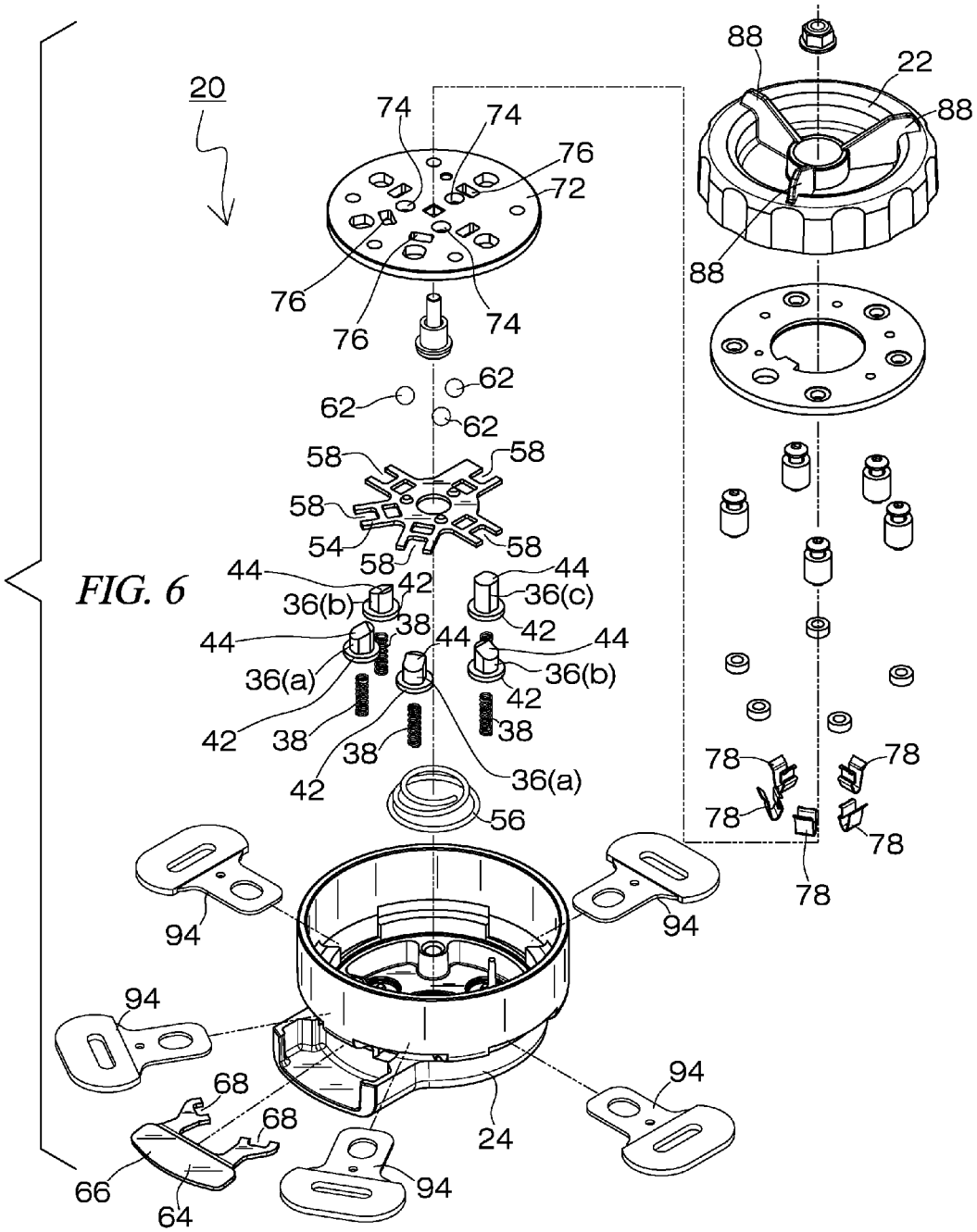
FIG. 6 is an exploded view of the rotary buckle along with the associated belt tongues.
Figure 7:
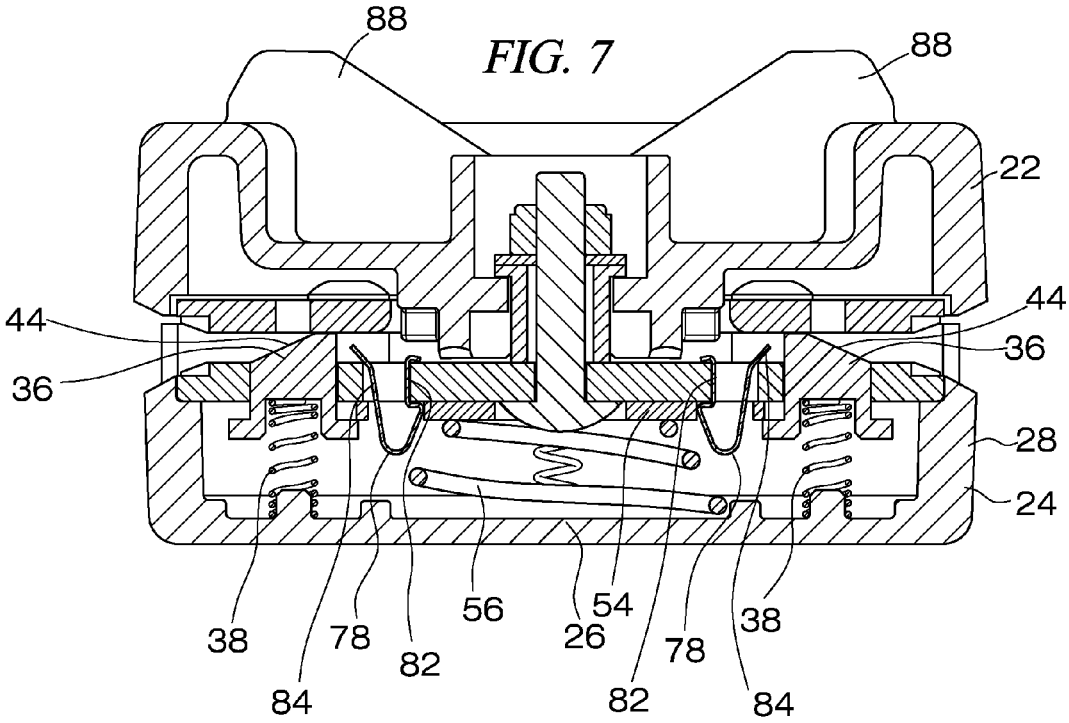
FIG. 7 is a cross sectional view of the rotary buckle taken along line 7-7 of FIG. 1.

With reference to the exploded views of FIGS. 5 and 6, the locking dogs 36 of the present invention are described. As noted more fully hereinafter, dogs 36 serve to lockingly engage a female opening in a corresponding tongue plate 94. As illustrated, locking dogs 36 are each interconnected to the inner surface 26 of second cover 24 via mounting springs 38. Springs 38 permit each dog 36 to be downwardly displaced against the spring force. Each of the locking dogs 36 further includes a lower peripheral flange 42 and an upper surface 44. As noted, each dog selectively secures one of the straps of the harness.

In the case of a five point harness, there are two shoulder dogs 36(*a*) for securing shoulder belts, two lap dogs 36(*b*) for securing lap belts, and one anchor dog 36(*c*) for securing a crotch belt. Shoulder dogs 36(*a*) and lap dogs 36(*b*) preferably include a beveled upper surface 44 to facilitate the insertion and withdraw of a tongue plate 94. However, anchor dog 36(*c*) does not include a beveled top surface 44. Moreover, in the preferred embodiment, anchor dog 36(*c*) is elongated with respect to the other dogs 36(*a*) and 36(*b*) such that it remains secured to tongue plate 94 while the other tongue plates are ejected. This ensures that the assembly 20 remains secured to one of the harness straps at all times.

Dogs 36 are moved into a unlocked orientation by way of a disengagement plate 54. Disengagement plate 54 is interconnected to the lower surface of first cover 22 via a primary spring 56. In the case of the depicted five point harness, disengagement plate 54 includes five peripherally located forks 58, with each fork 54 corresponding to a locking dog 36. Forks 54 are secured over the peripheral flange 42 of the corresponding locking dog 36, whereby the displacement of the disengagement plate 54 against the force of the primary spring 56 results in the displacement of the locking dogs 36 against the force of the mounting springs 38. Thus, the downward displacement of plate 54 displaces the locking dogs 36 to thereby release the tongue plates 94. However, as noted above, locking dog 36(*c*) is elongated and, therefore, remains lockingly engaged with its tongue plate 94 even upon displacement of plate 54.

Figure 8:
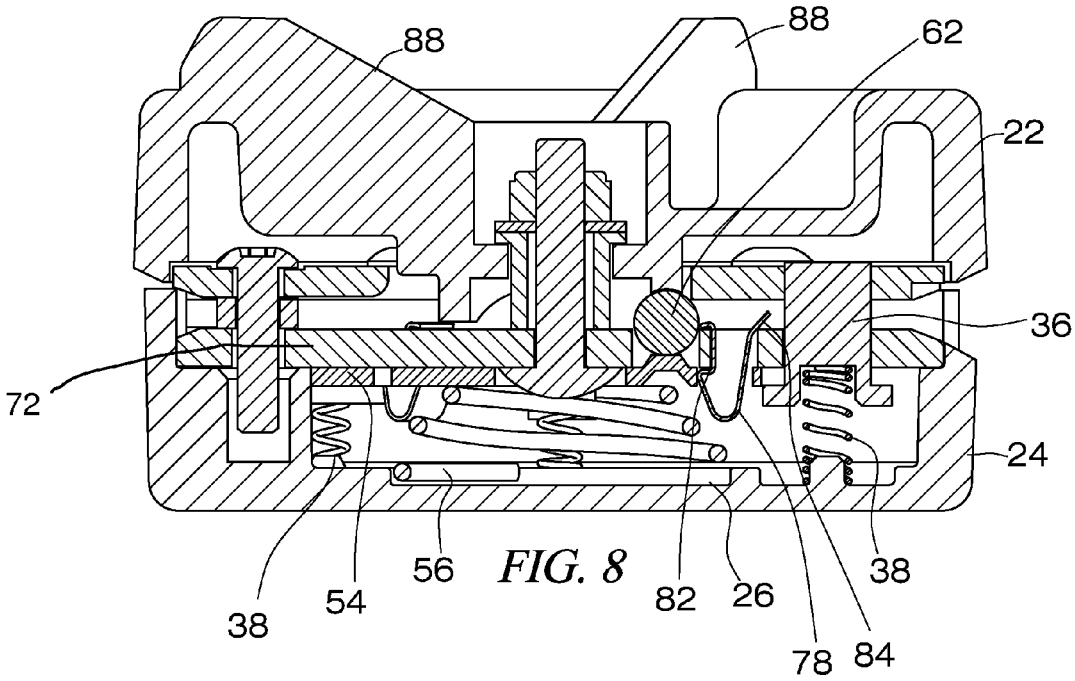
FIG. 8 is a cross sectional view of the rotary buckle taken along line 8-8 of FIG. 1.

As noted in the cross sectional view of FIG. 8, a series of bearings 62 are employed in the downward movement of displacement plate 54. In the preferred embodiment, three ball bearings 62 are utilized. These bearings 62 are supported within recesses in the disengagement plate 54. The exact function of these bearings is described in greater detail hereinafter.

An optional shoulder release plate 64 can also be included within assembly 20. Release plate 64 includes a handle 66 to be grasped by the user and oppositely disposed forks 68. In a fashion similar to the displacement plate 54, forks 68 of release plate 64 engage flanges 42 of the two shoulder dogs 36(*a*). As such, the pivoting and/or downward displacement of handle 64 results in the displacement of the two shoulder dogs 36(*a*) and the selective release of the tongue plates 94 of the shoulder straps. Shoulder plate 64 can be displaced without displacing disengagement plate 54. As a result, the user can selectively remove the shoulder straps without unlocking the remaining straps of the harness.

With continuing reference to FIGS. 5 and 6, a cover plate 72 is positioned over disengagement plate 54. Cover plate 72 includes a series of apertures 74 for receiving bearings 62 of disengagement plate 54. Cover plate 72 further includes a series five slotted openings 76, with the slotted openings 76 corresponding to the position of the five locking dogs 36. Cover plate 72 is secured to the disengagement plate 54 via conventional fasteners such that both plates reciprocate together during the ejection process. An additional upper plate can likewise be included within the housing as noted in the exploded views.

Figure 9:
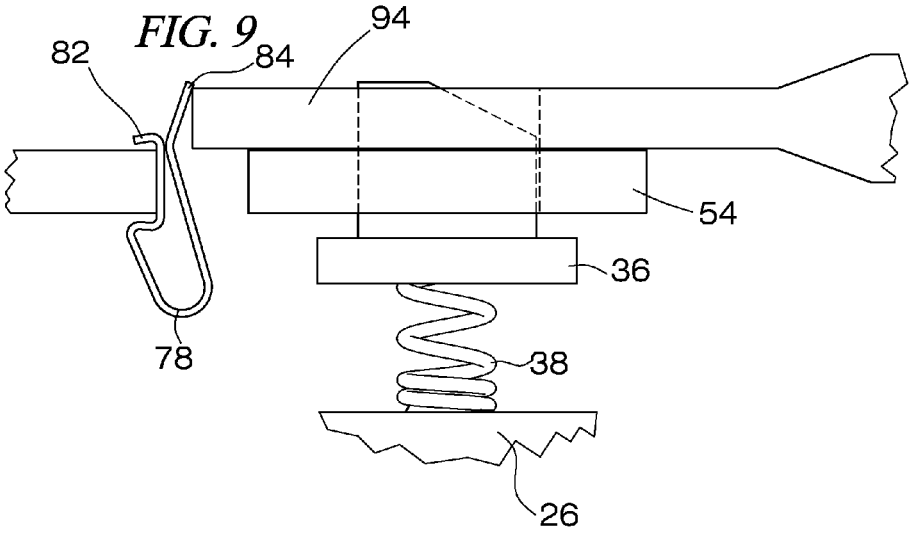
FIG. 9 is a detailed view of one of the ejector springs of the present invention with the belt tongue in the locked position.
Figure 10:
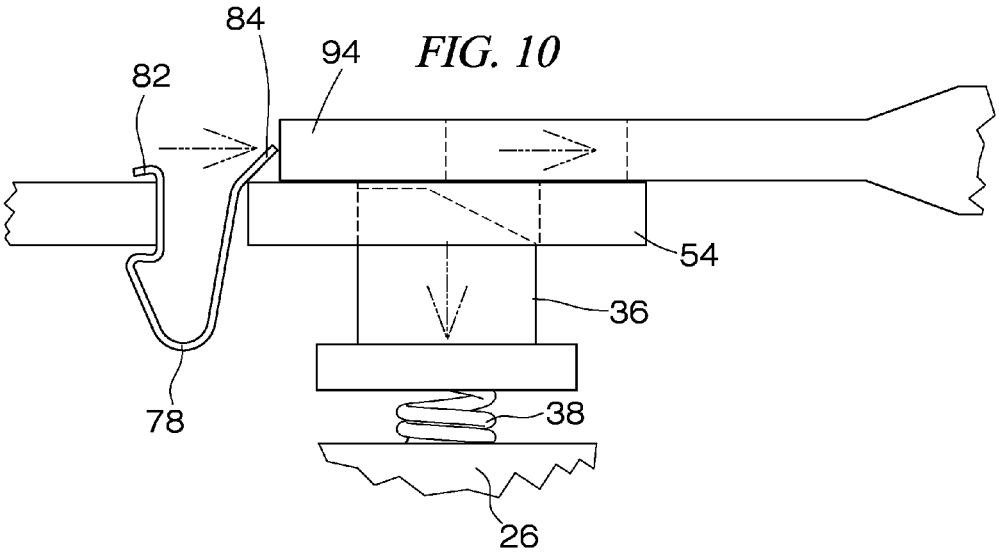
FIG. 10 is a detailed view of one of the ejector springs of the present invention with the belt tongue being ejected from the housing.

The ejector springs 78 of the present invention are next described in connection with FIGS. 9 and 10. In the preferred embodiment, a series of five ejector 78 springs are utilized, with each of the ejector springs 78 corresponding to an associated tongue plate. Each spring 78 is positioned within one of the slotted openings 76 of the cover plate 72. Each ejector spring 78 is designed to both secure its associated tongue plate 94 when locked and to forceably eject the tongue plate 94 when unlocked. In order to accomplish this, each ejector spring 78 includes a first half in the form of a c-shaped channel 82. This c-shaped channel 82 engages and is locked to the edge of the slotted opening 76 to which the spring is mounted. The other half of the spring is angled 84 and releasably engages the forward end of a corresponding tongue plate 94.

When in the locked orientation, the two halves 82 and 84 are forced together under tension. As such, when the dogs 36 are disengaged from the tongue plates 94 (as described above), the angled halves 84 of the springs 78 serve to forceably eject the tongue plates 94 from the assembly 20. However, when the dogs 36 are engaged, the angled halves 84 of the ejector springs 78 serve to secure and otherwise stabilize the tongue plate 94 within the assembly 20.

The assembly 20 is closed by way of the first cover 22. As illustrated, the first cover 22 is cylindrically shaped. First cover 22 is rotatably secured both to the second cover 24 and to the disengagement plate 54. In the preferred embodiment, first cover 22 includes a textured outer surface and three upstanding fins 88 to permit easy manipulation by the user. As illustrated in FIG. 4, first cover 22 includes an inner surface with a series of ramps 92. The number of ramps 92 corresponds to the number of bearings 62 included on the disengagement plate 54. In the depicted embodiment, three bearings 62 and three ramps 92 are utilized. The ramps 92 are in alignment with and engage the bearings 62 of disengagement plate 54. Rotation of the first cover 22 results in inclined ramps 92 sliding over bearings 62. This, in turn, results in the downward displacement of disengagement plate 54. This can be achieved by orienting bearings 62 within apertures in cover plate 72. Namely, as inclined ramps 92 incrementally engage bearings 62, bearings 62 contact disengagement plate 54 through the apertures within cover plate 72 (note FIG. 8). This, in turn, results in the downward movement of disengagement plate 54 and the release and ejection of the tongue plates 94.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described.

What is claimed is:

1. A buckle assembly adapted to selectively retain or eject a series of five tongue plates, the tongue plates associated with two shoulder belts, two lap belts and an anchor belt, each of the tongue plates having a locking aperture, the buckle assembly comprising:

a first cover including a textured outer surface with a series of upstanding fins, the first cover also including an inner surface with a series of three inclined ramps;

a cover plate interconnected to the first cover, the cover plate including a series of apertures and slotted openings, with each slotted opening defined by an edge, five ejector springs secured within the slotted openings, and three bearings positioned within the apertures, each of the ejector springs having a first channel shaped end and a second angled end, with each of the channel shaped ends engaging an associated edge, the bearings being in alignment with the three inclined ramps of the first cover;

a second cover rotatably interconnected to the first cover, the second cover including an inner surface and a peripheral sidewall, a series of five spaced tongue openings formed within the peripheral side wall, the tongue openings adapted to receive the tongue plates;

a series of five locking dogs, each of the locking dogs having a height, the locking dogs including two shoulder belt dogs, two lap belt dogs, and an anchor belt dog, the shoulder belt dogs and the lap belt dogs having inclined upper surfaces, the height of the anchor belt dog being greater than the height of the shoulder belt dogs and the lap belt dogs, each of the locking dogs interconnected to the inner surface of the second cover by way of mounting springs and further adapted to engage the locking aperture of an associated tongue plate, each of the locking dogs further including a peripheral flange;

a disengagement plate with five radially disposed forks, each of the forks engaging the flange of an associated locking dog, a primary spring interconnecting the disengagement plate to the inner surface of the second cover;

a shoulder plate including two forked extensions, the forked extensions positioned over the flanges associated with the shoulder belt dogs, whereby movement of the shoulder plate moves the shoulder belt dogs downwardly to unlock the associated tongue plates;

whereby rotation of the first cover relative to the second cover results in the inclined ramps engaging the bearings and moving the disengagement plate and locking dogs downward, such downward movement unlocking the tongue plates associated with the lap belts and shoulder belts but retaining the tongue plate associated with the anchor belt, and wherein the angled ends of the ejector springs forcibly eject the unlocked tongue plates.

2. A buckle assembly for releasably securing a series of tongue plates, the buckle assembly comprising:

a first cover including an inner surface with a series of ramps;

a cover plate interconnected to the first cover, the cover plate supporting a series of bearings and ejector springs, the bearings in alignment with the ramps of the first cover;

a second cover rotatably interconnected to the first cover, the second cover including an inner surface and a peripheral sidewall, a series of spaced tongue openings formed within the peripheral side wall, the tongue openings adapted to receive the tongue plates;

a series of locking dogs, each of the locking dogs interconnected to the inner surface of the second cover by way of mounting springs and further adapted to lockingly engage an associated tongue plate, each of the locking dogs further including a peripheral flange;

a disengagement plate with radially disposed forks, each of the forks engaging the flange of an associated locking dog, a primary spring interconnecting the disengagement plate to the inner surface of the second cover;

whereby rotation of the first cover relative to the second cover results in the ramps engaging the bearings and moving the disengagement plate and locking dogs downward, such downward movement unlocking the tongue plates, and wherein the ejector springs forcibly eject the unlocked tongue plates.

3. The buckle assembly as described in claim 2 wherein the buckle assembly releasably retains five tongue plates and wherein the tongue plates are associated with two lap belts, two shoulder belts and an anchor belt.

4. The buckle assembly as described in claim 2 wherein five locking dogs are used to releasably secure five associated tongue plates and wherein the locking dogs include two lap belt locking dogs, two shoulder belt locking dogs and one anchor belt locking dog.

5. The buckle assembly as described in claim 4 further comprising a shoulder plate including two forked extensions, the forked extensions positioned over the flanges associated with the shoulder belt dogs, whereby movement of the shoulder plate moves the shoulder belt dogs downwardly to unlock the associated tongue plates.

6. The buckle assembly as described in claim 2 wherein the cover plate includes a series of slotted openings, with each slotted opening including an edge, the series of ejector springs being positioned within the slotted openings.

7. The buckle assembly as described in claim 6 wherein each ejector spring includes a channel shaped end that engages the edge of an associated slotted opening.

8. The buckle assembly as described in claim 2 wherein the first cover includes a textured outer surface with a series of upstanding fins to facilitate user manipulation.

9. The buckle assembly as described in claim 2 wherein the cover plate includes a series of apertures for permitting the bearings to contact and displace the disengagement plate.

10. A buckle assembly for releasably securing a series of five tongue plates, the buckle assembly comprising:

a first cover including an inner surface;

a cover plate interconnected to the first cover, the cover plate supporting a series of ejector springs;

a second cover rotatably interconnected to the first cover, the second cover including an inner surface and a series of spaced tongue openings, the tongue openings adapted to receive the tongue plates;

a series of locking dogs, the locking dogs including two shoulder belt dogs, two lap belt dogs, and an anchor belt dog, each of the locking dogs interconnected to the inner surface of the second cover by way of mounting springs and further lockingly engaging an associated tongue plate;

a shoulder plate including two forked extensions, the forked extensions positioned over the shoulder belt dogs, whereby movement of the shoulder plate moves the shoulder belt dogs downwardly to unlock the associated tongue plates;

a disengagement plate engaging all of the locking dogs, a primary spring interconnecting the disengagement plate to the inner surface of the second cover, whereby rotation of the first cover with respect to the second cover results in the disengagement plate moving downwardly such that the tongue plates are disengaged from the locking dogs and the ejector springs forcibly eject the unlocked tongue plates.

* * * * *